US005941681A

United States Patent [19]

Piotrowski et al.

[11] Patent Number: 5,941,681

[45] Date of Patent: Aug. 24, 1999

[54] APPARATUS FOR PROCESSING FLAT, FLEXIBLE OBJECTS, FOR EXAMPLE PLASTIC OR PAPER CARDS

[75] Inventors: Karl Heinz Piotrowski, Olching; Keong-Swee Lee; Robert Stangl, both of Munich, all of Germany

[73] Assignee: Giesecke & Devrient GmbH, Munich, Germany

[21] Appl. No.: 08/822,351

[22] Filed: Mar. 20, 1997

[30] Foreign Application Priority Data

Mar. 20, 1996 [DE] Germany ..... 196 11 030

[51] Int. Cl.[6] ..... B65H 1/06

[52] U.S. Cl. ..... 414/797.8; 414/795.3; 414/933; 271/20; 271/99; 271/106; 271/107; 271/161

[58] Field of Search ..... 414/795.3, 797.8, 414/933; 271/3.07, 11, 20, 99, 106, 107, 161; 221/211, 311

[56] References Cited

U.S. PATENT DOCUMENTS

| | | | |
|---|---|---|---|
| 3,490,763 | 1/1970 | Darwin | 271/99 |
| 4,921,237 | 5/1990 | Nubson et al. | 271/161 |
| 5,288,065 | 2/1994 | Wysmuller | 271/161 |
| 5,472,184 | 12/1995 | Focke et al. | 271/99 |

FOREIGN PATENT DOCUMENTS

| | | | |
|---|---|---|---|
| 308034 | 12/1989 | Japan | 271/161 |
| 3-211135 | 9/1991 | Japan | 271/99 |
| 4-303344 | 10/1992 | Japan | 271/161 |
| 5-310329 | 11/1993 | Japan | 271/161 |
| 8802735 | 4/1988 | WIPO | 271/161 |

*Primary Examiner*—Christopher P. Ellis
*Assistant Examiner*—Douglas Hess
*Attorney, Agent, or Firm*—Bacon & Thomas, PLLC

[57] ABSTRACT

The apparatus has, along with a magazine in which flat, flexible objects such as cords are stored in a stack, a retaining device for holding the stack in the magazine. Symmetrically disposed retaining elements aligned parallel to the surface of the objects are provided in the retaining device. The form of the retaining elements is selected such that an object of the stack can be singled by being arched past the retaining elements and an object can also be stacked in the magazine by being arched past the retaining elements. A gripping device is provided for moving the objects.

18 Claims, 6 Drawing Sheets

APPARATUS FOR PROCESSING FLAT, FLEXIBLE OBJECTS, FOR EXAMPLE PLASTIC OR PAPER CARDS

BACKGROUND OF THE INVENTION

1. Field of the Invention

This invention relates to an apparatus for processing flat, flexible objects, for example plastic or paper cards.

2. Related Art

Such an apparatus is known from EP-OS 0 574 745. The cards to be processed are stored as a stack in a magazine of the apparatus. Provided on the magazine is a retaining device that holds the stack in the magazine. For processing, one card of the stack at a time is grasped by a gripping device and singled out of the magazine past the retaining device.

The retaining device has two rotatably driven shafts whose cross-section is recessed in the area of the thickness of the card so as to form a shoulder. The depth of the shoulder is equal to the thickness of the card to be singled. This card lies before singling between the shoulders of the two driven shafts. By a rotation of the shafts the card is arched and can then be grasped by the gripping device and singled out of the magazine.

EP-OS 0 279 851 also shows an apparatus wherein the cards are stored as a stack in a magazine. A retaining device holds the stack in the magazine. One card of the stack at a time is grasped by a gripping device and singled out of the magazine past the retaining device.

During singling, the card being singled is first arched or retaining projections of the retaining device and then guided diagonally downward so that the card being singled passes out of the range of action of a retaining projection.

A disadvantage of known apparatuses is that due to their construction they are only suitable for singling a card of the stack.

Assuming this, the invention is based on the problem of providing an apparatus for processing flat, flexible objects permitting both a card of a stack to be singled and a card to be stacked as a card of the stack.

This problem is solved by the features of the main claim.

SUMMARY OF THE INVENTION

The basic idea of the invention is essentially to provide retaining elements disposed symmetrically in the retaining device which are aligned parallel to the card surface. The form of the retaining elements is selected such that a card of the stack can be singled by being arched past the retaining elements, and a card can also be stacked as a card of the stack by being arched past the retaining elements.

The particular form of the retaining elements results according to the invention in an apparatus for both singling cards out of a magazine and stacking them into a magazine. If singling or stacking of the cards is each effected from the same side of the magazine, the apparatus can also store cards temporarily in a simple manner.

In a preferred embodiment of the invention the retaining device has at least two retaining steps with symmetrically disposed retaining elements. The retaining steps are disposed one behind the other at a certain distance in the direction perpendicular to the card surface. This increases the singling reliability of the apparatus.

Furthermore a pressure device that presses on the stack from above with a certain force is provided so that the card of the stack to be singled arches and comes off the following card of the stack. This reduces the danger of double pulls, which is caused for example by electrostatic adhesion of the cards to each other, and consequently increases the singling reliability further. A crossblowing device can be provided in order to reduce the adhesion between the cards additionally.

BRIEF DESCRIPTION OF THE DRAWINGS

In the following the preferred embodiment of the invention will be described on the basis of the figures, in which.

DETAILED DESCRIPTION OF PREFERRED EMBODIMENTS OF THE INVENTION

Figure 1A:
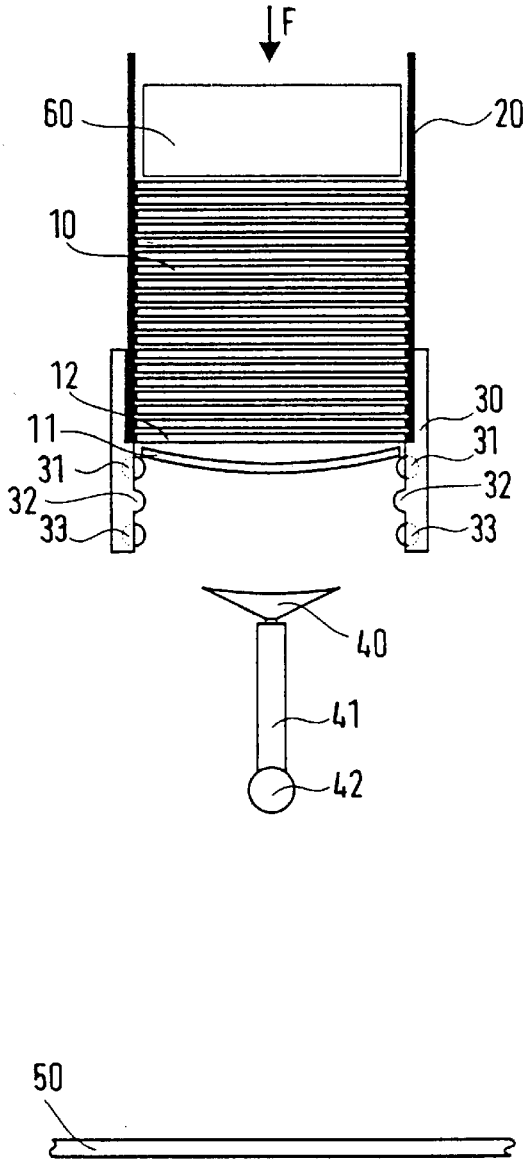
FIGS. 1*a*–1*b* show singling with the preferred embodiment of the invention.
Figure 1B:
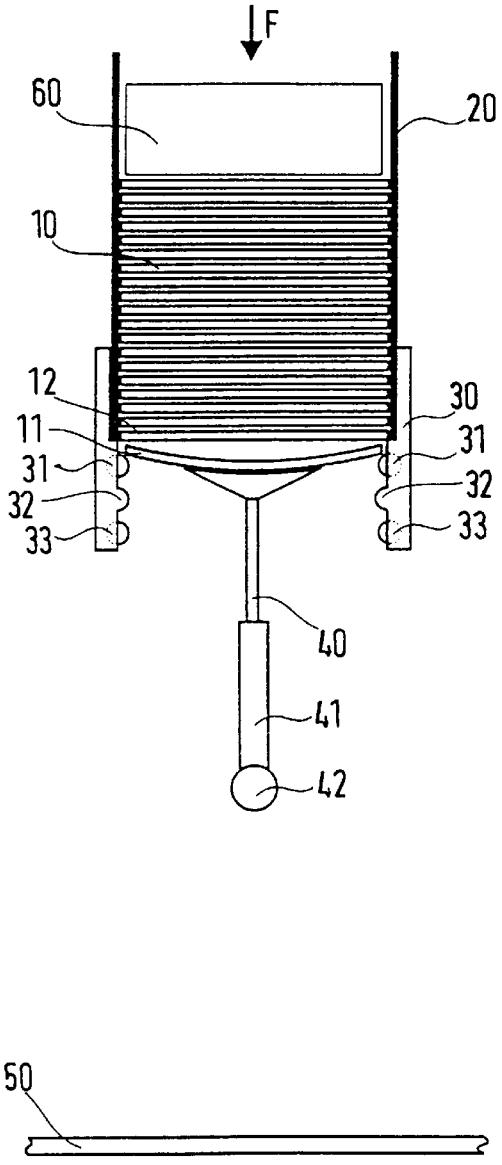

FIG. 1 shows singling with the preferred embodiment of the invention. The cards are stored as stack 10 in magazine 20. On the magazine retaining device 30 is provided. Retaining device 30 has retaining elements 31, 32, 33 disposed symmetrically and aligned parallel to the bottom card surface. The retaining elements are shaped such that the bottom card 11 can be singled by a gripper device by being arched past retaining elements 31, 32, 33 and a card also stacked as card 11 of the magazine by being arched past retaining elements 31, 32, 33.

The retaining elements are preferably of semicircular design. Suitable retaining elements are for example retaining rolls 31 and 33 that are disposed in free-running fashion on a stationary axis. The axes of retaining rolls 31, 33 are disposed such that the retaining rolls protrude semicircularly into the area of the magazine. Alternatively the retaining elements can also be designed as retaining projections 32 protruding semicircularly into the area of the card magazine.

Figure 6:
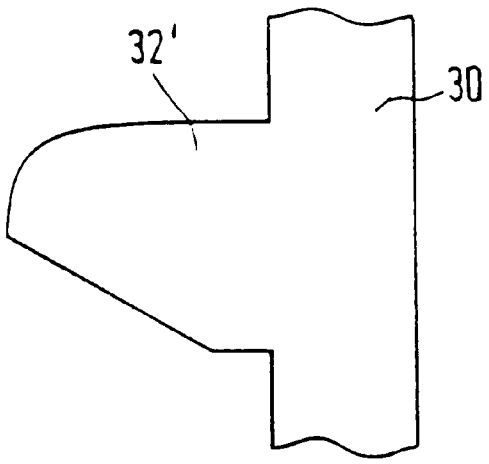
FIG. 6 shows an alternative form of the retaining elements.

An alternative form of retaining projection 32 is shown in FIG. 6. In retaining projection 32' the upper half is greatly curved while the lower half is an inclined plane. The advantage of this form is that a relatively great force acts on card 11 during singling so that the card is separated from following card 12 with high reliability during singling. When card 11 is stacked into magazine 20 the plane of retaining element 32' exerts only relatively small forces on card 11 being stacked so that it can be stacked into magazine 20 easily and without great signs of wear.

In the preferred embodiment according to FIG. 1 the retaining device has three retaining steps with two symmetrically disposed retaining elements 31, 32, 33 in each case. The three retaining steps are disposed one behind the other at a certain distance in the direction perpendicular to the bottom card surface.

The gripping device has sucker 40 that can be moved in and out by means of drive 41. Sucker 40 is fastened with drive 41 to bearing 42 about which sucker 40 can be turned with drive 41.

The singled card is received by schematically shown transport device 50 that can then transport the singled card to further-processing apparatuses for example.

Further, pressure device 60 is provided that presses on stack 10 from above with force F so that bottom card 11 of the stack arches and comes off and separation from the following card 12 of the stack. The pressure device can have for example a ram that can be driven by a drive in the direction of force F. However the pressure device is preferably realized merely by a weight, as shown in FIG. 1. The size of the weight depends on the nature of the cards and on the number of cards in the magazine.

Figure 5:
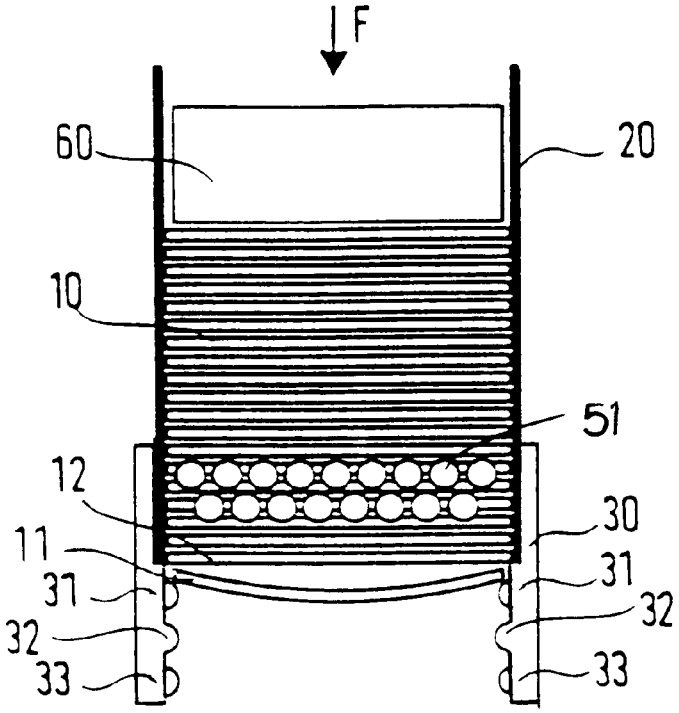
FIG. 5 shows a preferred embodiment with a crossblowing device.

In order to reduce the adhesion of the cards to each other additionally, one can provide crossblowing device 51, as shown in FIG. 5, for blowing air between the cards of stack 10 in the lower area of the stack.

If retaining device 30 only has one retaining step 31 it is possible to single card 11 by having a driven pressure device press on stack 10 from above with such a great force F that bottom card 11 of the stack arches enough to be singled past retaining elements 31.

For singling card 11 of the stack, sucker 40 is preferably first turned into an engaged position, as shown in FIG. 1*a*. By being moved out, sucker 40 can grasp card 11 of the stack according to FIG. 1*b*. Sucker 40 is then moved downward again, whereby card 11 of the stack is singled by being arched past retaining elements 31, 32 and 33.

Figure 1C:
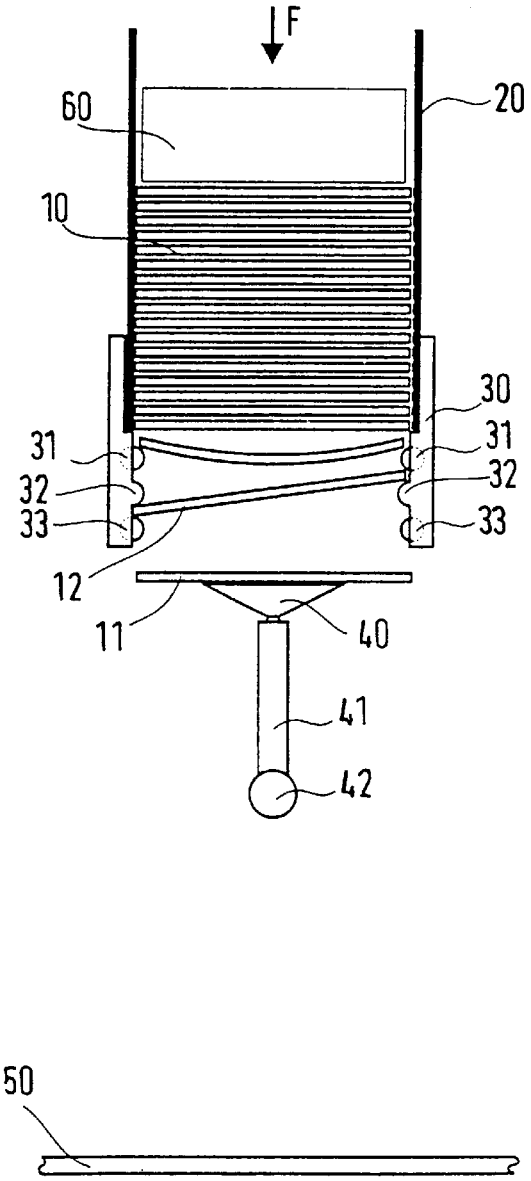
Figure 1D:
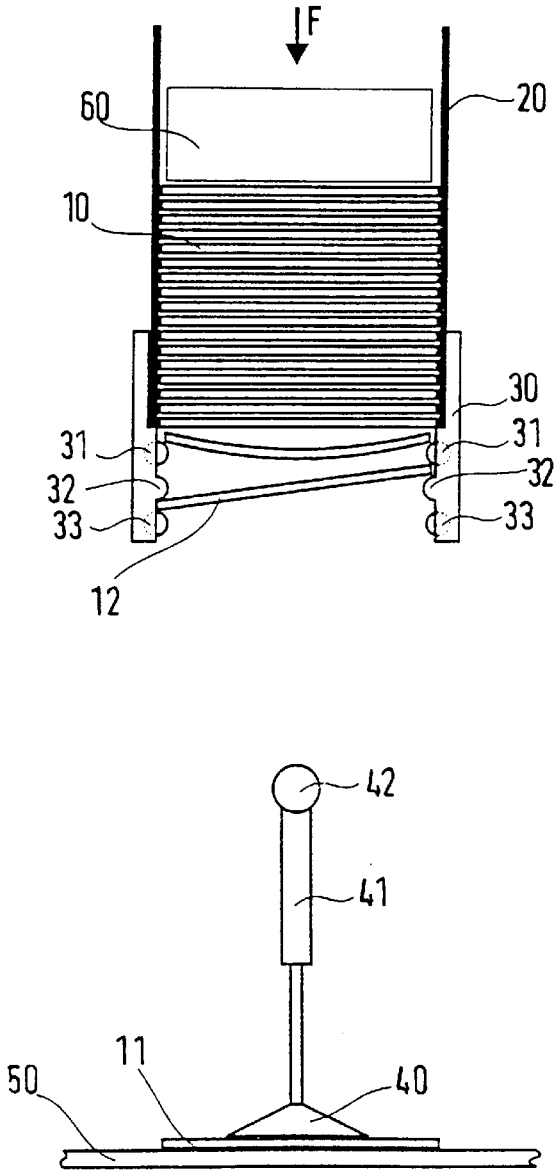
Figure 2A:
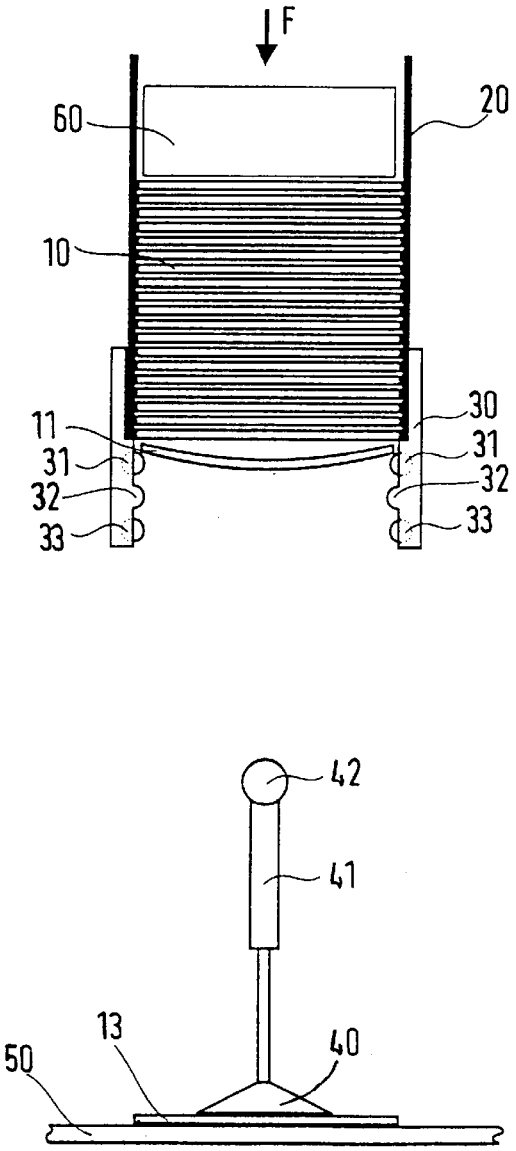
FIGS. 2*a*–2*d* show stacking with the preferred embodiment.
Figure 2B:
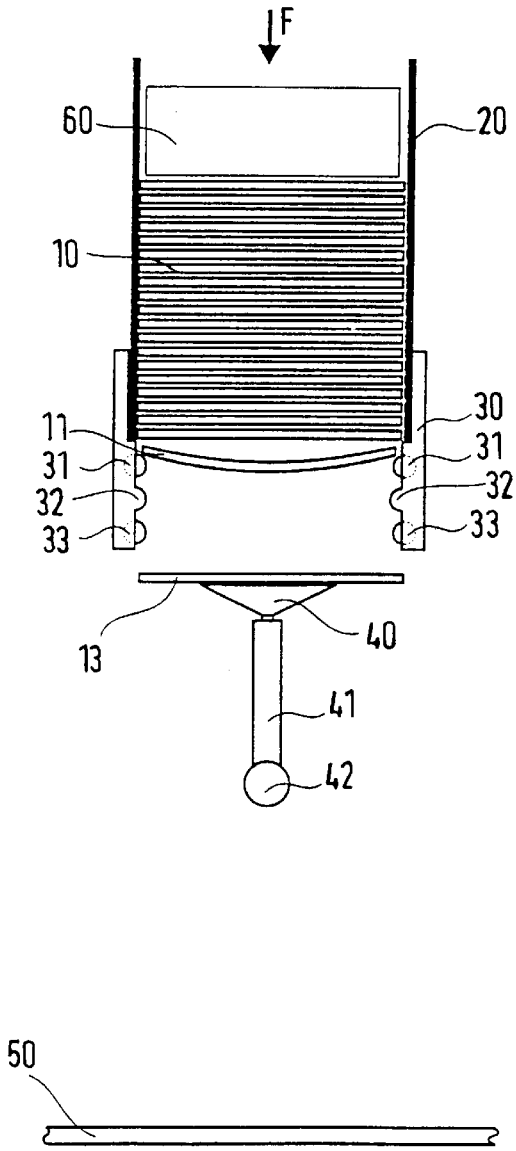
Figure 2C:
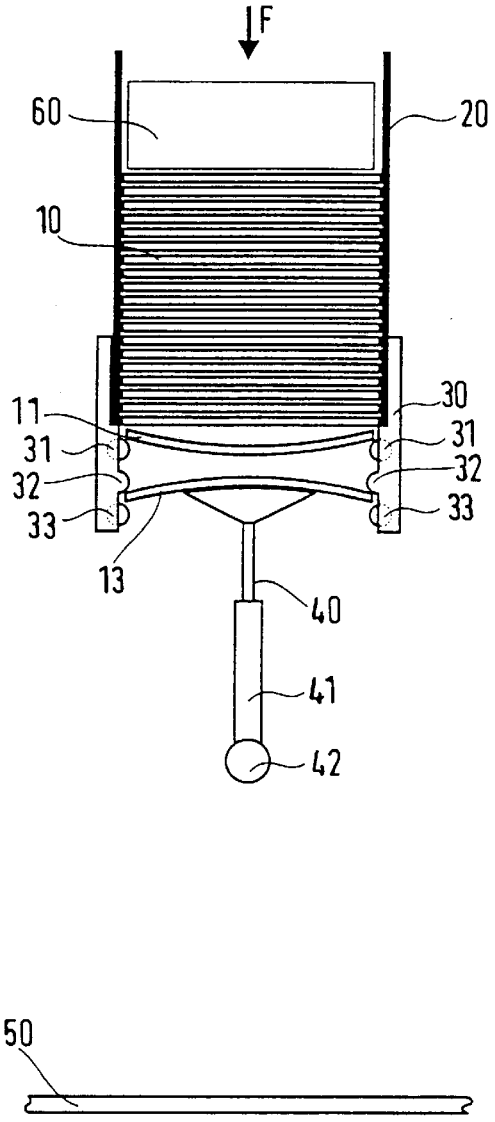
Figure 2D:
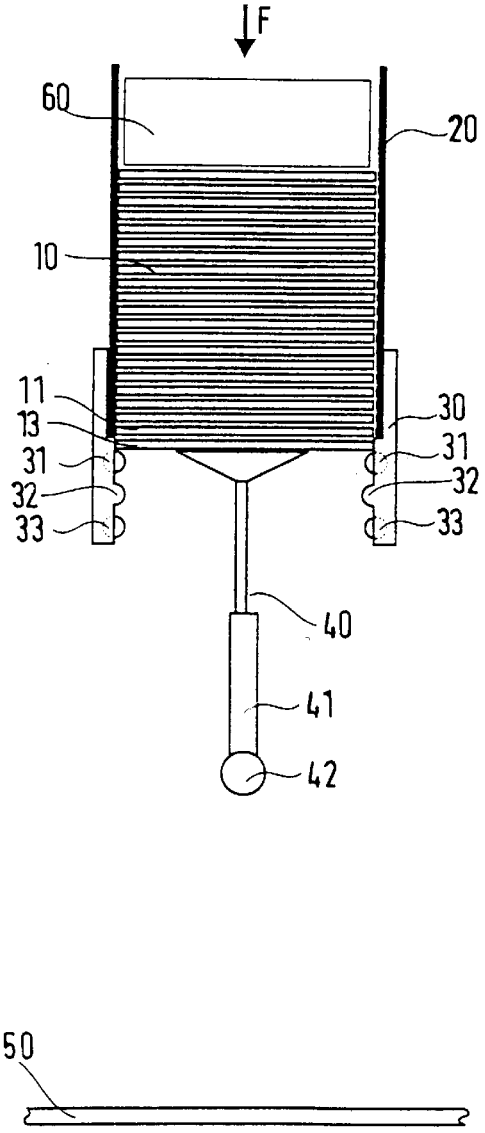

FIG. 1*c* shows how sucker 40 holds already singled card 11 in the engaged position. Should following card 12 be singled as well via first retaining step 31 as a double pull for example due to dirt or electrostatic adhesion, there is a great likelihood that adhering cards 11 and 12 will be separated by the arching on retaining steps 32, 33 so that following card 12 remains between second or third retaining step 32, 33. Rotation of sucker 40 with card 11 about axis 42 and the moving out of sucker 40 cause card 11 to be deposited on transport device 50, as shown in FIG. 1*d*.

The sucker is then turned back into the engaged position according to FIG. 1*a* and can single the next card for example. If one or more cards are still located between retaining steps 31, 32, 33 they are first stacked in magazine 20 again by being arched past retaining elements 31, 32, 33 when sucker 40 moves out.

The stacking of a card as a card of the stack is shown in FIG. 2. In FIG. 2*a* sucker 40 grasps card 13 to be stacked located on transport device 50. The sucker is then turned with card 13 to be stacked into the engaged position according to FIG. 2*b*. By being moved out according to FIG. 2*c* sucker 40 stacks card 13 to be stacked as a card in magazine 20 by arching it past retaining elements 31, 32, 33. As FIG. 2*d* shows, sucker 40 is for that purpose moved out so far that card 13 to be stacked is located above retaining elements 31, 32, 33. Now sucker 40 can for example stack a card from the transport device into the magazine again, or else single card 13 of the stack out of magazine 20 again as described above, so that card 13 is merely stored for a certain time in magazine 20.

Figure 3:
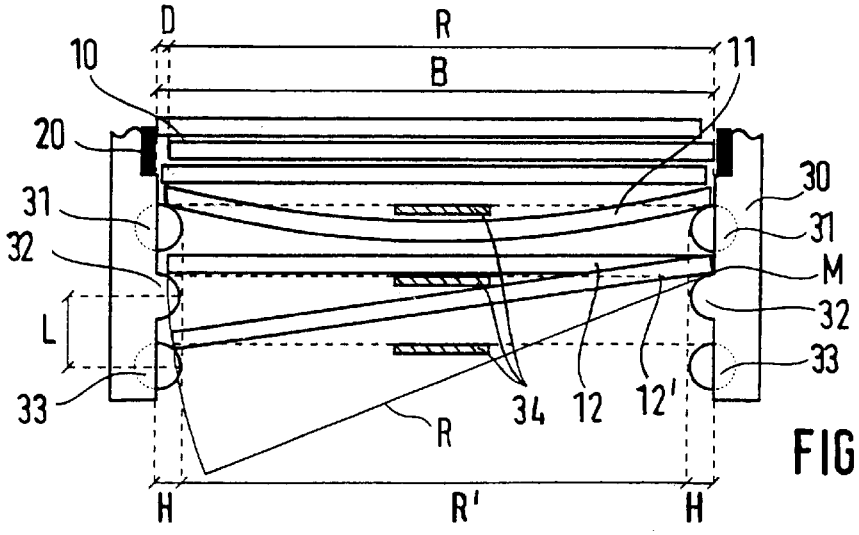
FIG. 3 shows the arrangement of the retaining elements of the preferred embodiment, FIGS. 4*a* and *b* show the removal of the card magazine from the preferred embodiment.

The geometrical peculiarities of the preferred embodiment are shown in FIG. 3. The cards of stack 10 have length R. Width B of card magazine 20 is selected such that the cards of stack 10 have small free space D into which the cards can be mutually shifted to the right or left. The size of space D results from the difference between magazine width B and card length R.

Height H of the retaining elements is measured from the side of the card magazine and corresponds to the radius of the retaining elements if they are semicircular. If the retaining elements have another form, for example a semiellipse or tri-angle, height H of the retaining elements is defined as the greatest distance between the side of the card magazine and the boundary line of the retaining elements.

Height H of the retaining device must be greater than free space D so that both right and left shifted cards of stack 10 are prevented from falling out of the magazine.

Maximum height H of the retaining devices depends on the flexibility of the cards. High flexibility of the cards means that they can be strongly arched without damage. Distance R' between the highest points of the retaining elements results from width B of the card magazine minus twice selected height H of the retaining devices and corresponds to an effective length of the arched card. Small effective length means strong arching of the card. The greater height H of the retaining elements is selected, the smaller distance R' between the highest points of the retaining elements is and thus the stronger the arching of the card. Maximum height H of the retaining device is thus determined by the maximum possible arching of the cards without them being damaged.

It is generally favorable to keep arching as small as possible even with flexible cards in order to avoid material fatigue from arching. This means that height H of the retaining devices is preferably selected so as to yield effective length R' of the arched card that is not essentially smaller than length R of the unarched card.

If at least two retaining steps 32 and 33 are disposed one behind the other at distance L in the direction perpendicular to the card surface, as in the preferred embodiment of the invention, height H of retaining elements 32 and 33 is selected so great that the two retaining elements 32 and 33 are each cut on one side of an arc, the arc having radius R of the card length and center M of the circle lying on the other side at the height of upper retaining element 32. This permits both horizontally lying card 12 and diagonally lying card 12' to be held safely without falling out of retaining device 30.

In order to obtain maximum singling reliability one can optimize distance L between two retaining steps in accordance with the transport speed of the gripping device. If required, the transport speed can of course also be optimized in accordance with distance L.

To increase singling reliability further, it is possible to provide feathered plates 34 in one or more of retaining steps 31, 32, 33 for stabilizing the position of the cards. Jamming of the cards in retaining device 30 can thus be largely prevented. Feathered plates 34 are preferably provided symmetrically in the opposite walls of retaining device 30 which have no retaining elements 31, 32, 33.

Since the retaining device can be executed with relatively simple technical measures it is possible to connected retaining device 30 firmly with magazine 20. The advantage of this embodiment is that no further measurements must be taken to prevent cards from falling out of magazine 20, for example during transport of magazine 20.

Figure 4A:
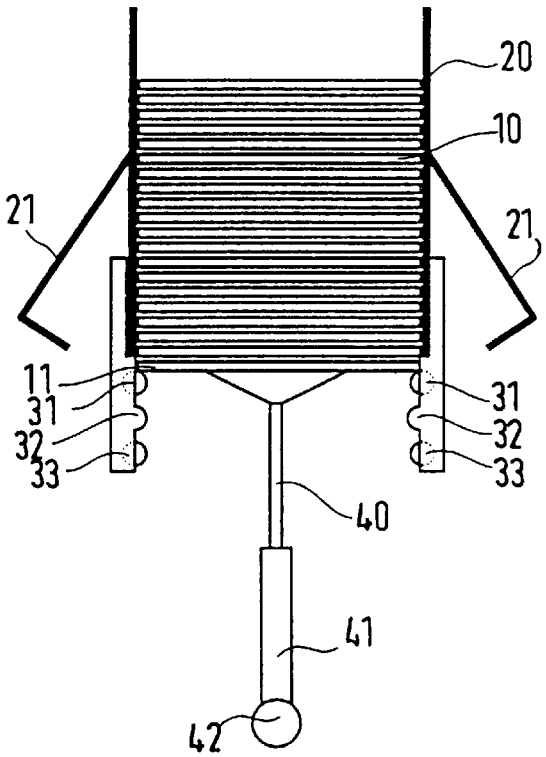
Figure 4B:
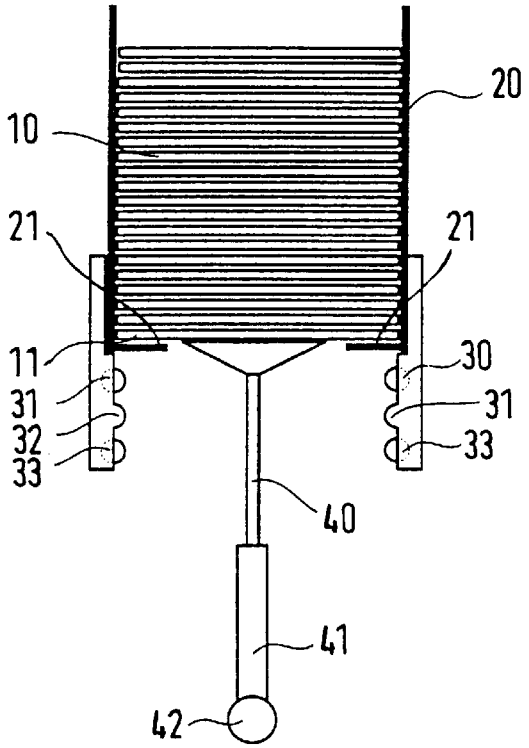

Alternatively to this embodiment FIG. 4 shows magazine 20 with additional holding devices 21 that prevent cards from falling out of magazine 20, for example during transport of magazine 20. FIG. 4*a* shows how holding devices 21 have moved out of magazine 20 for stacking or singling cards 10 of the magazine. For moving holding devices 21 out and in one can for example move sucker 40 into a position according to FIG. 4*b* so that cards 10 of the magazine are lifted over the engagement point of holding devices 21. In this position holding devices 21 can be easily moved in and out of magazine 20. The design of holding devices 21 is shown here only schematically. Suitable design of such holding devices 21 can be executed by the expert if required.

In the embodiments shown in FIGS. 1 to 4 the lowermost card of the stack is singled or a card is stacked as the lowermost card of the stack. However the basic idea of the invention is not restricted to these embodiments. It is quite possible to design the embodiments such that magazine 20 with retaining device 30 is at a certain angle, for example 45°, to transport device 50. If suitable retaining device 30 is mounted on the upper side of magazine 20 it is also possible to single cards out the magazine or stack them into the magazine from above. Any combinations of the described embodiments are also possible. Any necessary adaptations can be easily performed by the expert.

We claim:

1. An apparatus for processing flat, flexible objects, in particular, plastic or paper cards having generally planar opposed surfaces, the apparatus comprising:

a magazine (20) in which the cards are stored as a stack (10), a retaining device (30) for holding the stack (10) in the magazine, and a gripping device (40, 41, 42) for grasping one card of the stack at a time and singling it out of the magazine past the retaining device, wherein:

the retaining device (30) has symmetrically disposed retaining elements (31, 32, 33) that are aligned parallel to a card surface and shaped such that the gripping device (40, 41, 42) can both single a card (11) of the stack (10) by arching the card past the retaining elements (31, 32, 33) and stack a card (14) as a card of the stack (10) by arching the card past the retaining elements (31, 32, 33);

and wherein the retaining device (30) has at least two retaining steps with symmetrically disposed retaining elements (31, 32, 33), and two retaining steps are spaced one behind the other at a distance (L) in a direction perpendicular to a card surface.

2. The apparatus of claim 1, wherein the retaining elements have free-running retaining rolls (31, 33).

3. The apparatus of claim 1, wherein the retaining elements have retaining projections (32).

4. The apparatus of claim 3, wherein the form of the retaining projections (32) is semicircular.

5. The apparatus of claim 3, wherein the form of the retaining projections (32') is such that a force acting on a card (11) to be processed is greater for separation of a card to be processed from the stack than for stacking such card into the stack.

6. The apparatus of claim 1, wherein the retaining steps of the retaining elements (31, 32, 33) have a height (H) such that the two retaining elements are intersected on one side of the retainer device (30) by an imaginary circular arc having a radius (R) of a card length spanning the stack transversely with the center of the arc (M) lying on the other side of the retainer device (30) at the height of the retaining element closest to the card to be processed.

7. The apparatus of claim 1, wherein said distance (L) is selected so that the retaining elements function optimally with a transport speed of the gripping device.

8. The apparatus of claim 1, wherein a transport speed of the gripping device is optimized in accordance with the distance (L).

9. The apparatus of claim 1, including a pressure device (6) provided for pressing on the stack (10) from above with a force (F) so that a bottom card (11) of the stack to be singled arches and separates from the following card (12) of the stack.

10. The apparatus of claim 9, wherein the pressure device (60) comprises a weight.

11. The apparatus of claim 9, wherein the pressure device (60) comprises a ram with a drive.

12. The apparatus of claim 1, wherein the retaining device (30) has feathered plates (34).

13. The apparatus of claim 1, wherein the retaining device (30) is secured rigidly with the magazine (20).

14. The apparatus of claim 1, wherein the magazine (20) comprises movable holding devices (21).

15. The apparatus of claim 1, wherein the gripping device includes a sucker (40).

16. The apparatus of claim 1, including a crossblowing device (50) that directs air between the individual cards in a lower area of the stack (10).

17. The apparatus of claim 1, including a pressure device (60) for pressing on the stack from above with a force (F) so that a bottom card (11) of the stack to be singled arches and is separated from the retaining device (30).

18. The apparatus of claim 17, characterized in that the pressure device (60) has a ram with a drive.

* * * * *